United States Patent [19]

Volk

[11] Patent Number: 4,818,121

[45] Date of Patent: Apr. 4, 1989

[54] CARRYING HANDLE

[76] Inventor: Henry J. Volk, 3512 Hawkeye, Turlock, Calif. 95380

[21] Appl. No.: 180,283

[22] Filed: Apr. 11, 1988

Related U.S. Application Data

[63] Continuation-in-part of Ser. No. 76,799, Jul. 23, 1987, Pat. No. 4,772,133.

[51] Int. Cl.[4] ..... B65D 33/06

[52] U.S. Cl. ..... 383/6; 383/13; 383/71; 383/78; 294/137; 294/164

[58] Field of Search ..... 383/6, 13, 25, 29, 74, 383/78, 71; 294/137, 149, 152, 153, 164, 166

[56] References Cited

U.S. PATENT DOCUMENTS 2,981,990 5/1961 Balderree, Jr. ..... 383/25

3,002,240 10/1961 Laguerre ..... 383/13

4,112,541 9/1978 Tetradis ..... 383/13

4,596,397 6/1986 Conti ..... 383/71

*Primary Examiner*—Willis Little

[57] ABSTRACT

A carrying handle is provided for use in conjunction with wrapped food items wherein the wrapping is secured at one end with a retaining clip. The carrying handle has a finger hold allowing the user to grab the handle with one or more fingers, a pair of flexible arms which allow the carrying handle to either lie flat against the food item or to be lifted away from the food item, a clamp which is drawn into position around the shrink wrapping and a pair of flexible fingers which bend outwardly as the wrapping is inserted into the clamp and then return to their normal position in which they engage the wrapping and keep the wrapping in the clamp.

3 Claims, 1 Drawing Sheet

CARRYING HANDLE

CROSS-REFERENCE TO RELATED APPLICATION

This application is a continuation-in-part of application Ser. No. 076,799 filed July 23, 1987, now U.S. Pat. No. 4,772,133.

SUMMARY OF THE INVENTION

This invention relates generally to a carrying handle for wrapped food items, such as whole-bodied turkeys, which have been shrink-wrapped and wherein the shrink wrap is secured at one end with a retaining clip.

In particular, the present invention constitutes an improvement over the carrying handle disclosed in my co-pending patent application Ser. No. 076,799 filed on July 23, 1987 entitled CARRYING HANDLE FOR BAGGED FOOD ITEMS, which is incorporated herein by reference.

The objects of the present invention include all of the objects stated for the invention disclosed in application Ser. No. 076,799 and, in addition, the present invention provides a carrying handle which has a clamp and flexible arms which carry a pair of flexible, resilient fingers which move generally away from each other as the carrying handle is applied to the wrapping in order to minimize the force needed to apply the handle. When the wrapping is inserted into the clamp, the flexible fingers return to their normal position in which they are over the top of the wrapping to prevent the wrapping from coming out of the clamp.

The present invention, therefore, reduces the force necessary to apply the carrying handle to the wrapped food item while simultaneously providing a rather secure locking mechanism once the handle is in place and the resilient fingers have extended to their position over the top of the wrapping.

Other objects and advantages of the invention will become apparent from the following description and the drawings.

DETAILED DESCRIPTION OF THE DRAWINGS

Figure 1:
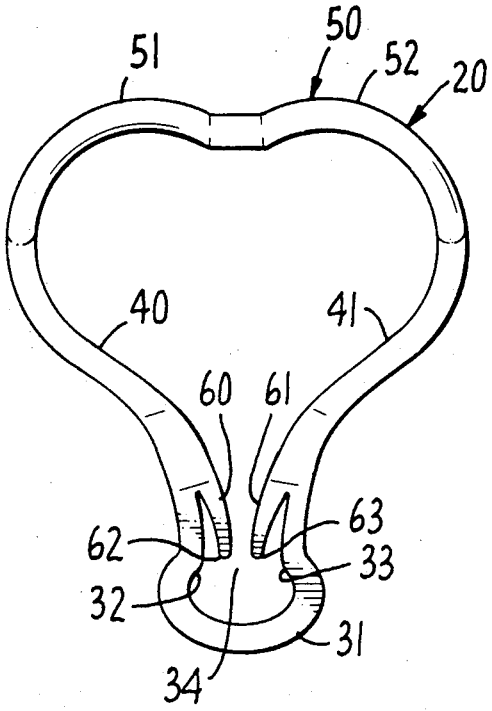
FIG. 1 is an elevational view of a carrying handle according to the present invention.
Figure 2:
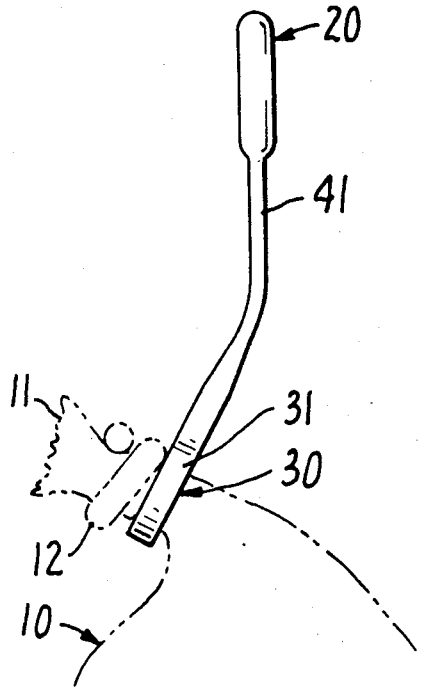
FIG. 2 is a side elevational view of the apparatus shown in FIG. 1 shown with a whole bodied, wrapped turkey.

Referring to FIGS. 1 and 2, a carrying handle indicated generally as 20 is shown for use in carrying food items such as a whole bodied turkey 10 which has been wrapped as by shrink wrapping and wherein the shrink wrapping 11 is secured at one end with a typically metallic retaining clip 12. We refer to the drawings in co-pending application Ser. No. 076,799 with respect to the whole bodied turkey and retaining clip and note generally that the carrying handle of the present invention is intended to be applied in substantially the same fashion as shown in application Ser. No. 076,799.

Clamping means shown generally as 30 comprises a generally elliptically-shaped ring 31 of between 270°–300°. An opening 34 is formed between the ends 32 and 33 of clamping ring 31.

A pair of flexible arm means 40 and 41 is connected to clamping means 30. In the embodiments shown in FIGS. 1–5, the carrying handle is molded plastic and is a single piece. Arms 40 and 41 are relatively flexible compared to clamping means 30 because of reduced thickness as shown best in FIG. 2. The thickness of arms 40 and 41 is 50% or less than the thickness of clamping ring 31.

Finger-hold means 50 is connected to flexible arms 40 and 41 and includes a pair of arcuate loops 51 and 52 adapted to receive fingers of the user. As shown best in FIG. 2, the thickness of finger-hold means 50 is at least 150% the thickness of arms 40 and 41.

A pair of fingers 60 and 61 are carried by flexible arms means 40 and 41, respectively. Although the invention would operate using a single flexible finger, the preferred embodiment incorporates a pair of fingers. Fingers 60 and 61 extend inwardly from flexible arm means 40 and 41, and extend in a direction toward the center of the elliptical opening formed by clamping ring 31. As the handle 20 is being applied to the wrapping 11 of a full bodied turkey 10, the tips 62 and 63 of fingers 60 and 61, respectively, bend to a first position shown in FIG. 3A in which they are parallel with and adjacent to flexible arm means 40 and 41 and in which tip 62 of finger 60 is adjacent to the end 32 of clamping ring 31 and wherein the tip 63 of finger 61 is adjacent to the end 33 of clamping ring 31. In this first position of fingers 60 and 61, the opening formed between fingers 60 and 61 is maximized to facilitate the easy insertion of the carrying handle 20 onto the shrink wrapped food item.

Figure 3A:
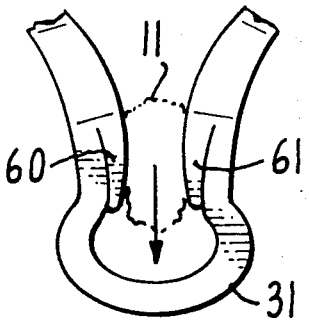
FIGS. 3A and 3B show how the device of FIG. 1 is applied to a wrapped food item.
Figure 3B:
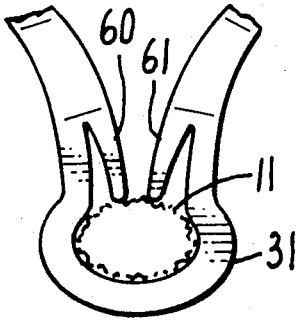

Once the carrying handle 20 is applied to the wrapping between the retaining clip and the food item, so that the wrapping 11 is fully inserted into the clamping ring 31, as shown in FIG. 3B fingers 60 and 61 spring back to a second position (their normal position) as shown in FIG. 1, in which they extend inwardly from flexible arms 40 and 41 and engage the wrapping in order to prevent the wrapping from coming out of clamping ring 31. In the normal position of fingers 60 and 61, they extend over the top of the wrapping to prevent the wrapping from coming out of clamping ring 31, and thereby prevent the carrying handle 20 from falling off of the wrapped food item.

Figure 4:
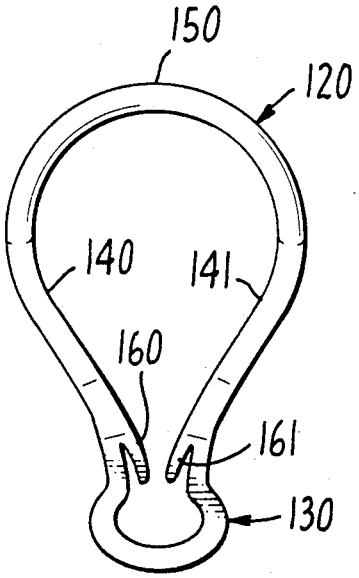
FIG. 4 is an elevational view of an alternate embodiment of the invention.
Figure 5:
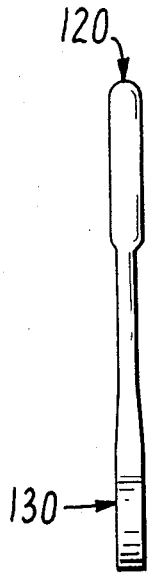
FIG. 5 is a side elevational view of the handle shown in FIG. 4.

FIGS. 4 and 5 show an alternate embodiment 120 of the carrying handle, which is similar to the embodiment shown in FIGS. 1 and 2, except that the finger hold 150 is designed to accommodate one finger instead of two and the food items, with which the carrying handle 120 is used, are smaller food items. Clamping means 130 is intended to grip the wrapping between the retaining clip and food item. Flexible arms 140 and 141 are provided which lie flat against the food item in one position and extend away from the food item in the carrying position. Fingers 160 and 161 facilitate the insertion of the device and prevent the inadvertent falling off of the handle from the food item.

What is claimed is:

1. A carrying handle for use in conjunction with food items which have been wrapped and wherein said wrapping is secured at one end with a retaining clip, comprising:

clamping means adapted to be placed into position around said wrapping at a point between said retaining clip and said food item, finger-hold means connected to said clamping means whereby the user inserts one or more fingers into said finger-hold means to carry said food item, a pair of flexible arm means located between said clamping means and said finger-hold means whereby said carrying handle will either lie against said food item or may be pulled away from said food item as said food item is carried, and at least one finger means carried by said flexible arm means, said finger means being adapted to move to a first position to facilitate insertion of said handle onto said wrapping, and to move to a second position to prevent said handle from inadvertently falling off the wrapping of said food item.

2. The device of claim 1 wherein two fingers are used and said fingers are flexible and bend to a first position parallel with and adjacent to said flexible arms as said handle is applied to said wrapping, and, after said handle is applied, said fingers bend to a second position extending inwardly from said flexible arms and engaging said wrapping.

3. The device of claim 2 wherein said clamping means forms an elliptical opening and wherein said fingers extend from said flexible arms in a direction toward the center of said elliptical opening.

* * * * *